US010847890B2

(12) United States Patent
Kim et al.

(10) Patent No.: US 10,847,890 B2
(45) Date of Patent: Nov. 24, 2020

(54) LOW-LOSS AND FLEXIBLE TRANSMISSION LINE-INTEGRATED ANTENNA FOR MMWAVE BAND

(71) Applicant: SENSORVIEW INCORPORATED, Gyeonggi-do (KR)

(72) Inventors: Byoung Nam Kim, Gyeonggi-do (KR); Hong Il Yoo, Seoul (KR); Sang Woo Han, Gyeonggi-do (KR)

(73) Assignee: SENSORVIEW INCORPORATED, Gyeonggi-Do (KR)

( * ) Notice: Subject to any disclaimer, the term of this patent is extended or adjusted under 35 U.S.C. 154(b) by 0 days.

(21) Appl. No.: 16/591,069

(22) Filed: Oct. 2, 2019

(65) Prior Publication Data

US 2020/0127378 A1 Apr. 23, 2020

(30) Foreign Application Priority Data

Oct. 18, 2018 (KR) ..... 10-2018-0124672

(51) Int. Cl.

| | |
|---|---|
| ***H01Q 9/16*** | (2006.01) |
| ***H01Q 9/04*** | (2006.01) |
| ***H01Q 1/24*** | (2006.01) |
| ***H01Q 9/30*** | (2006.01) |
| ***H01Q 13/10*** | (2006.01) |

(52) U.S. Cl.

CPC ..... *H01Q 9/045* (2013.01); *H01Q 1/243* (2013.01); *H01Q 9/16* (2013.01); *H01Q 9/30* (2013.01); *H01Q 13/10* (2013.01)

(58) Field of Classification Search

None

See application file for complete search history.

(56) References Cited

U.S. PATENT DOCUMENTS

| | | | |
|---|---|---|---|
| 2005/0030230 | A1 | 2/2005 | Otaka et al. |
| 2012/0088402 | A1 | 4/2012 | Li et al. |
| 2015/0084825 | A1 | 3/2015 | Lee et al. |

FOREIGN PATENT DOCUMENTS

| | | | |
|---|---|---|---|
| KR | 10-2005-0050055 | A | 5/2005 |
| KR | 10-2007-0071816 | A | 7/2007 |
| KR | 10-2008-0082547 | A | 9/2008 |

OTHER PUBLICATIONS

Office Action dated May 16, 2019 issued in Korean Patent Application No. KR 10-2018-0124672, with English translation.

Office Action from corresponding Taiwanese Patent Application No. 10920885480, dated Sep. 15, 2020.

*Primary Examiner* — Graham P Smith

(74) *Attorney, Agent, or Firm* — Harness, Dickey & Pierce, P.L.C.

(57) ABSTRACT

Disclosed is a low-loss and flexible transmission line-integrated antenna for an mmWave band. The low-loss and flexible transmission line-integrated antenna includes an antenna and a transmission line integrated with the antenna. Here, the antenna includes a dielectric substrate formed of a dielectric having a certain thickness on a ground plate, a signal conversion portion which is formed on the dielectric substrate and converts an electrical signal of a mobile communication terminal into an electromagnetic signal and radiates the electromagnetic signal into the air or receives an electromagnetic signal in the air and converts the electromagnetic signal into an electrical signal of the mobile communication terminal, and an electricity feeding portion formed on the dielectric substrate and connected to the signal conversion portion.

14 Claims, 15 Drawing Sheets

LOW-LOSS AND FLEXIBLE TRANSMISSION LINE-INTEGRATED ANTENNA FOR MMWAVE BAND

CROSS-REFERENCE TO RELATED APPLICATION

This application claims priority to and the benefit of Korean Patent Application No. 10-2018-0124672, filed on Oct. 18, 2018, the disclosure of which is incorporated herein by reference in its entirety.

FIELD

The present invention relates to an antenna for mmWave band, and more particularly, to a low-loss and flexible transmission line-integrated antenna for an mmWave band, in which a low-loss nanosheet, which is not based on poly imide or liquid crystal polymer which is conventional and has high loss, is used and a transmission line and an antenna are integrated to be applicable to a mobile device.

BACKGROUND

A next-generation 5G mobile communication system performs communication through a high frequency band of several ten gigas, and even a smart phone needs a high frequency band antenna of several ten gigas therein. Particularly, a mobile built-in antenna used in a mobile device such as a smart phone receives a lot of influence of an environment in the smart phone. Here, it is necessary to locate an antenna at a position of minimizing an influence of surroundings. Also, in order to transmit or treat a superhigh frequency at a low loss, a low-loss and high performance transmission line is necessary.

Generally, dielectrics used in an antenna and a transmission line may further reduce power dissipation at a lower loss of a dielectric constant. Accordingly, to manufacture a transmission line and an antenna which have a low-loss and high performance for ultrahigh frequency signal transmission, it is necessary to use a material having a low relative dielectric constant and a low loss tangent if possible. Particularly, in order to efficiently transmit signals having frequencies in bands of 3.5 GHz and 28 GHz used in 5G mobile communication network, the significance of a transmission line and an antenna which have a low loss even in an mmWave band of 28 GHz more and more increases.

SUMMARY

The present invention is directed to provide a low-loss and flexible transmission line-integrated antenna for an mmWave band, in which a material having a low relative dielectric constant and a low loss tangent value is used and a transmission line and an antenna, which have a low loss and high performance, are integrated using a flexible material having a variety of flexibilities.

The present invention is also directed to provide a mobile communication terminal including the low-loss and flexible transmission line-integrated antenna for an mmWave band.

According to one aspect of the present invention, there is provided a low-loss and flexible transmission line-integrated antenna for an mmWave band. The low-loss and flexible transmission line-integrated antenna includes an antenna and a transmission line integrated with the antenna. Here, the antenna includes a dielectric substrate formed of a dielectric having a certain thickness on a ground plate, a signal conversion portion which is formed on the dielectric substrate and converts an electrical signal of a mobile communication terminal into an electromagnetic signal and radiates the electromagnetic signal into the air or receives an electromagnetic signal in the air and converts the electromagnetic signal into an electrical signal of the mobile communication terminal, and an electricity feeding portion formed on the dielectric substrate and connected to the signal conversion portion. The transmission line includes a central conductor which has one end connected to the electricity feeding portion of the antenna and transmits the transmitted or received electrical signal, an external conductor which has the same axis as that of the central conductor and surrounds the central conductor in an axial direction of the central conductor, and a dielectric formed between the central conductor and the external conductor in the axial direction. The dielectric is a sheet material having a nanostructure formed by electrospinning a resin at a high voltage.

The conductors and the nanosheet dielectric may be formed to have not only a single lamination structure but also a multilayer structure in which a plurality of layers are repeated and may transmit and receive multiple signals at the same time through the multiple structure. Also, for a bonding structure which has reliability between the conductor and the nanosheet dielectric, the conductor and the nanosheet dielectric may be connected using a bonding sheet of a structure having a low relative dielectric constant of a thin film layer and a low dielectric loss.

The antenna may include a microstrip patch signal radiator, a variety of patch types of antenna radiators, or a diagonal line type patch antenna structure. The antenna radiator patch may be located at an uppermost end part, a nanosheet dielectric having a certain thickness may be formed on a bottom surface of the antenna radiator patch, and a ground plate formed of a metal may be further provided on a lowermost end surface. To efficiently couple each of the conductors with the nanosheet dielectric, a bonding force may be strengthened using a low-loss dielectric bonding sheet and a conductor may be directly formed on a nanosheet.

The transmission line coupled with the antenna may use the nanosheet dielectric as the dielectric and be formed of a stripline including a plurality of via holes along an edge in a direction parallel to a signal line, and a signal conductor line of the stripline may be directly connected to a radiator patch conductor.

The antenna may be a dipole antenna, a monopole antenna, or a built-in antenna built in a mobile communication terminal and may include a planar inverted F antenna (PIFA).

The antenna may include a slot antenna in which a variety of slots are formed.

According to another aspect of the present invention, there is provided a mobile communication terminal including the above-described low-loss transmission-integrated antenna which utilizes the nanosheet dielectric.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which.

DETAILED DESCRIPTION

Figure 1A:
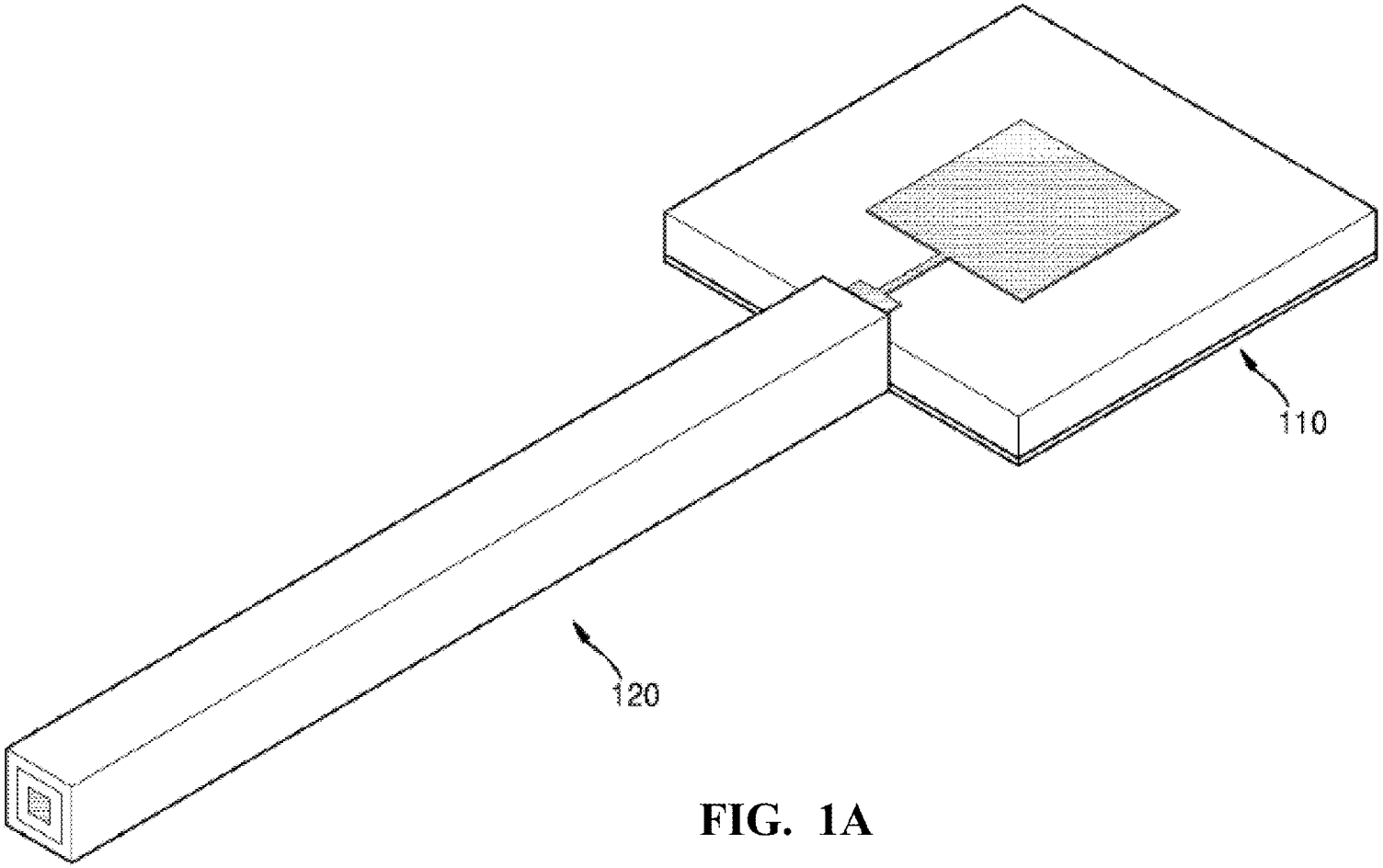
FIG. 1A is a perspective view of a transmission line-integrated patch antenna as an example of a low-loss and flexible transmission line-integrated antenna for an mmWave band according to the present invention.

Hereinafter, exemplary embodiments of the present invention will be described in detail with reference to the attached drawings. Since embodiments disclosed in the specification and components shown in the drawings are merely exemplary embodiments of the present invention and do not represent an entirety of the technical concept of the present invention, it should be understood that a variety of equivalents and modifications capable of substituting the embodiments and the components may be present at the time of filing of the present application.

Figure 1B:
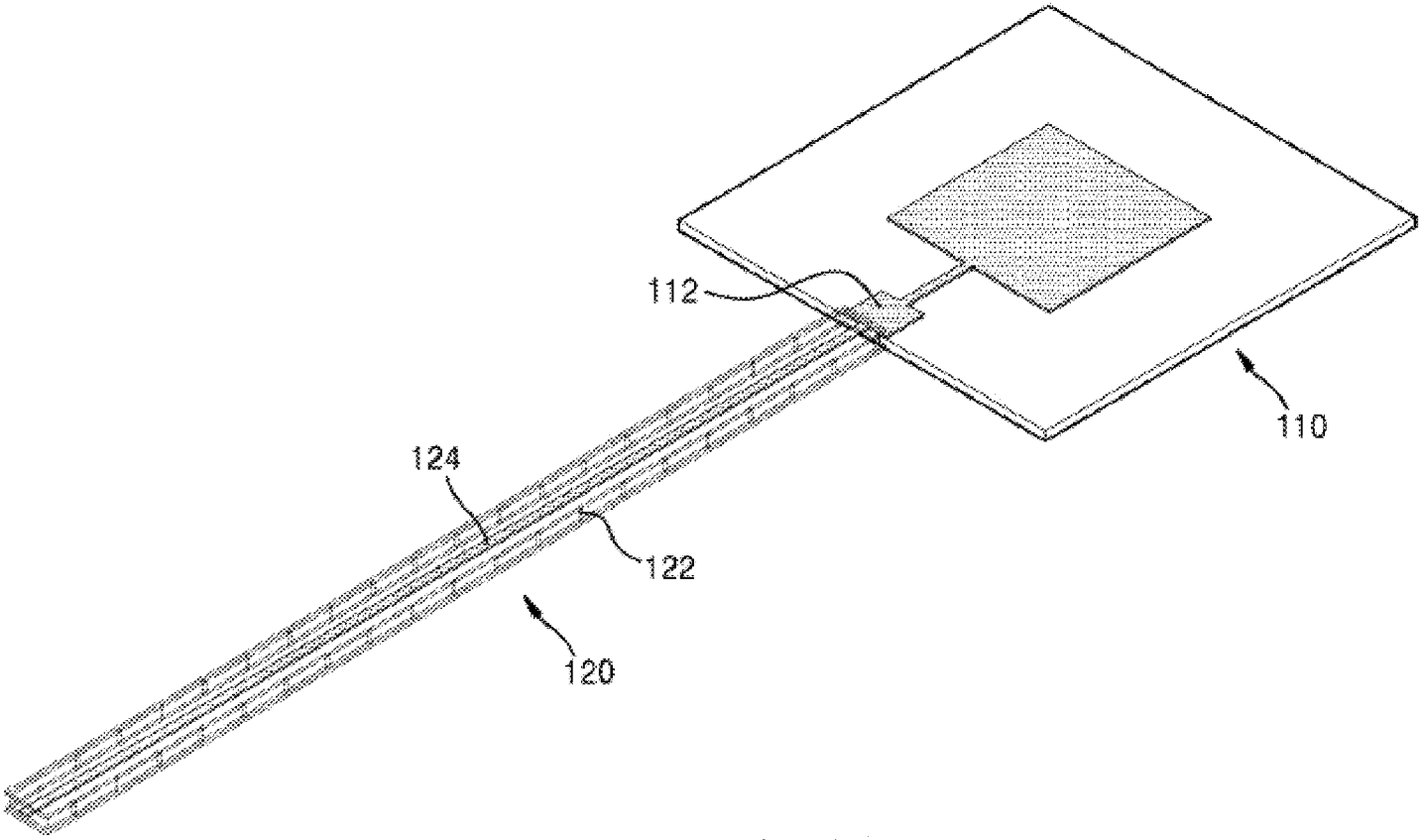
FIG. 1B is a perspective view of a transmission line-integrated antenna which utilizes a substrate integrated waveguide (SIW) structure which is applicable to mass production.
Figure 1C:
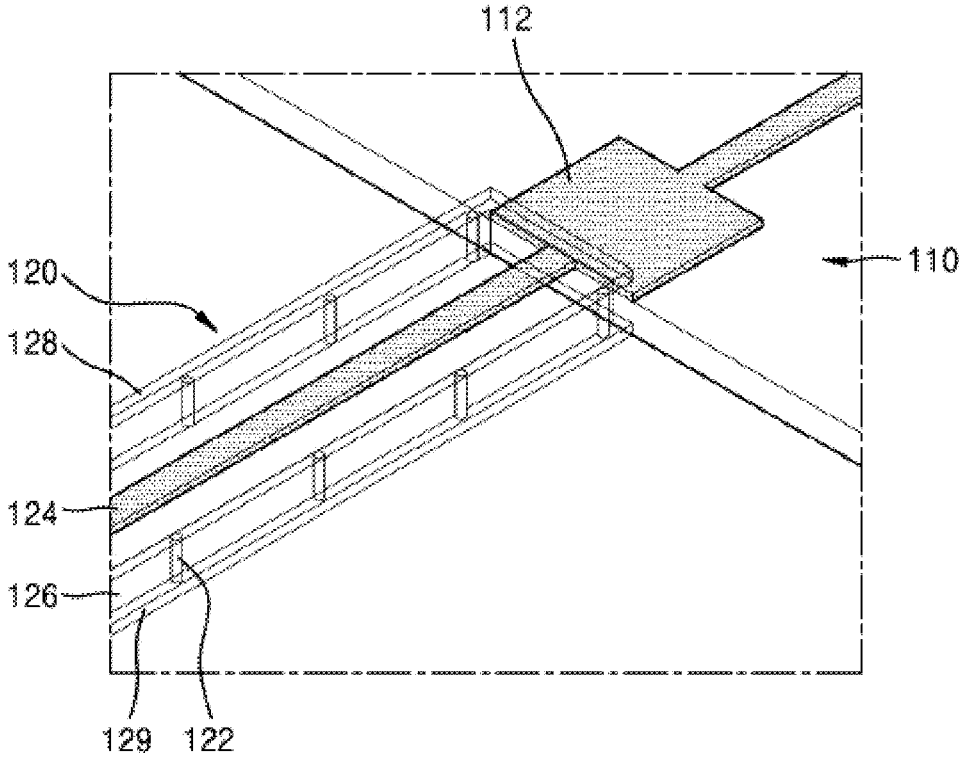
FIG. 1C is an enlarged view illustrating the SIW structure of the transmission line-integrated antenna in FIG. 1B.

FIG. 1A is a perspective view of a transmission line-integrated patch antenna as an example of a low-loss and flexible transmission line-integrated antenna for an mmWave band according to the present invention. FIG. 1B is a perspective view of a transmission line-integrated antenna which utilizes a substrate integrated waveguide (SIW) structure which is applicable to mass production. FIG. 1C is an enlarged view illustrating the SIW structure of the transmission line-integrated antenna in FIG. 1B.

Figure 2:
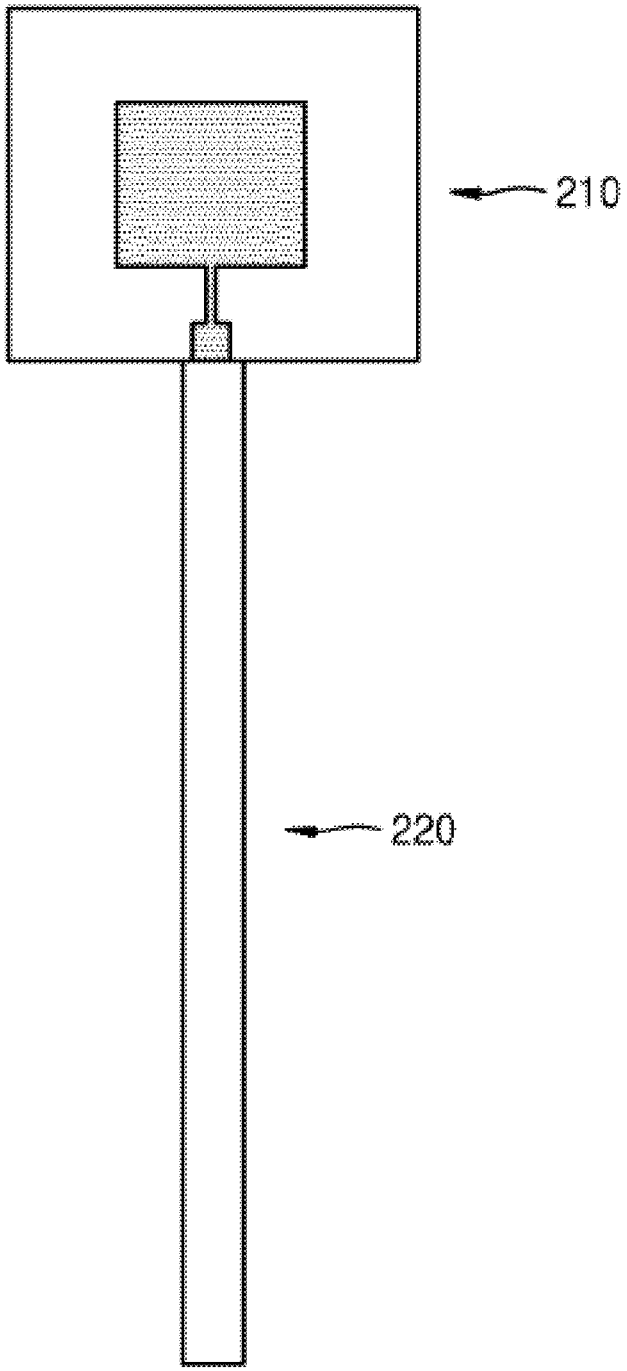
FIG. 2 is a plan view of a low-loss and flexible transmission line-integrated antenna for an mmWave band according to one embodiment of the present invention.
Figure 3:
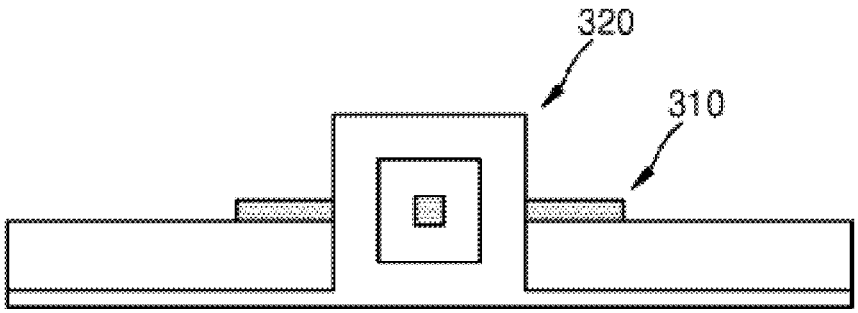
FIG. 3 is a front view of a low-loss and flexible transmission line-integrated antenna for an mmWave band according to one embodiment of the present invention.

FIG. 2 is a plan view of a transmission line-integrated patch antenna according to one embodiment of the present invention. FIG. 3 is a front view of a transmission line-integrated patch antenna according to one embodiment of the present invention.

Referring to FIGS. 1 to 3, a transmission line-integrated patch antenna for an mmWave band as an example of a low-loss and flexible transmission line-integrated antenna for an mmWave band according to the present invention includes an antenna 110, 210, or 310 and a transmission line 120, 220, or 320 integrated with the antenna 110, 210, or 310.

Figure 4:
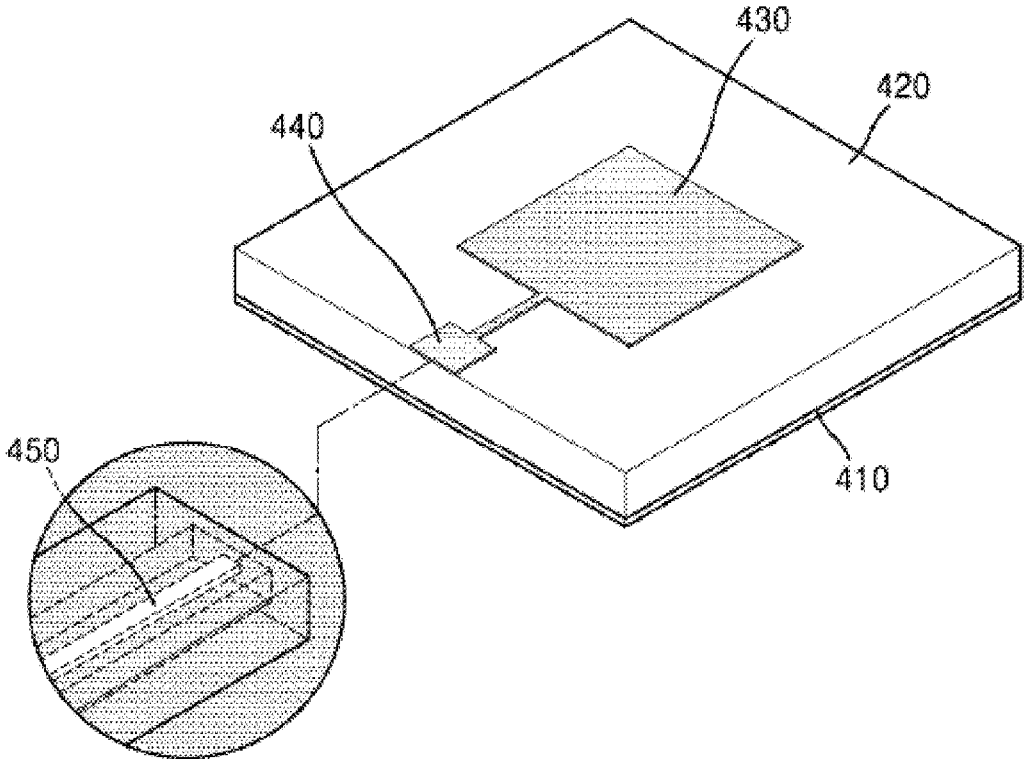
FIG. 4 is a perspective view of a patch antenna according to an example of a low-loss and flexible transmission line-integrated antenna for an mmWave band according to the present invention.
Figure 5:
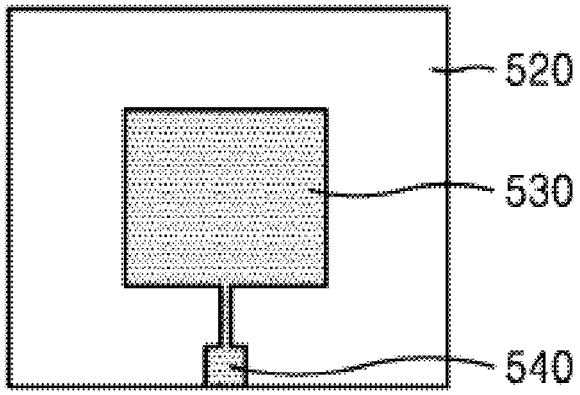
FIG. 5 is a plan view of a patch antenna according to an example of a low-loss and flexible transmission line-integrated antenna for an mmWave band according to the present invention.
Figure 6:
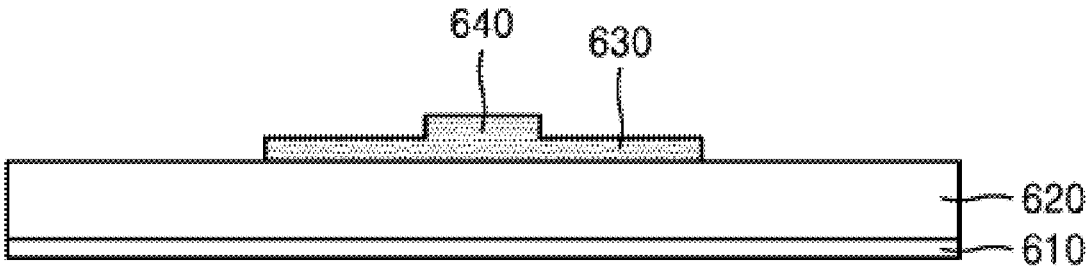
FIG. 6 is a front view of a patch antenna according to an example of a low-loss and flexible transmission line-integrated antenna for an mmWave band according to the present invention.

FIG. 4 is a perspective view of a patch antenna according to an example of a low-loss and flexible transmission line-integrated antenna for an mmWave band according to the present invention. FIG. 5 is a plan view of a patch antenna according to an example of a low-loss and flexible transmission line-integrated antenna for an mmWave band according to the present invention. FIG. 6 is a front view of a patch antenna according to an example of a low-loss and flexible transmission line-integrated antenna for an mmWave band according to the present invention.

Referring to FIGS. 1 to 6, the antenna 110, 210, or 310 includes a ground plate 410 or 610, a dielectric substrate 420, 520, or 620, a signal conversion portion 430, 530, or 630, and an electricity feeding portion 440, 540, or 640.

The ground plate 410 or 610 is located on a bottom surface of the patch antenna 110 or 210, performs a function of a ground, and includes a metal.

The dielectric substrate 420, 520, or 620 is formed of a dielectric having a certain thickness on the ground plate 410 or 610.

The signal conversion portion 430, 530, or 630 is formed on the dielectric substrate 420, 520, or 620 and converts an electrical signal of a mobile communication device into an electromagnetic wave signal and radiates the electromagnetic wave signal into the air or receives and converts an electromagnetic wave signal in the air into an electrical signal of the mobile communication terminal.

The electricity feeding portion 440, 540, or 640 is formed on the dielectric substrate 420, 520, or 620 and is connected to the signal conversion portion 430, 530, or 630.

Figure 7:
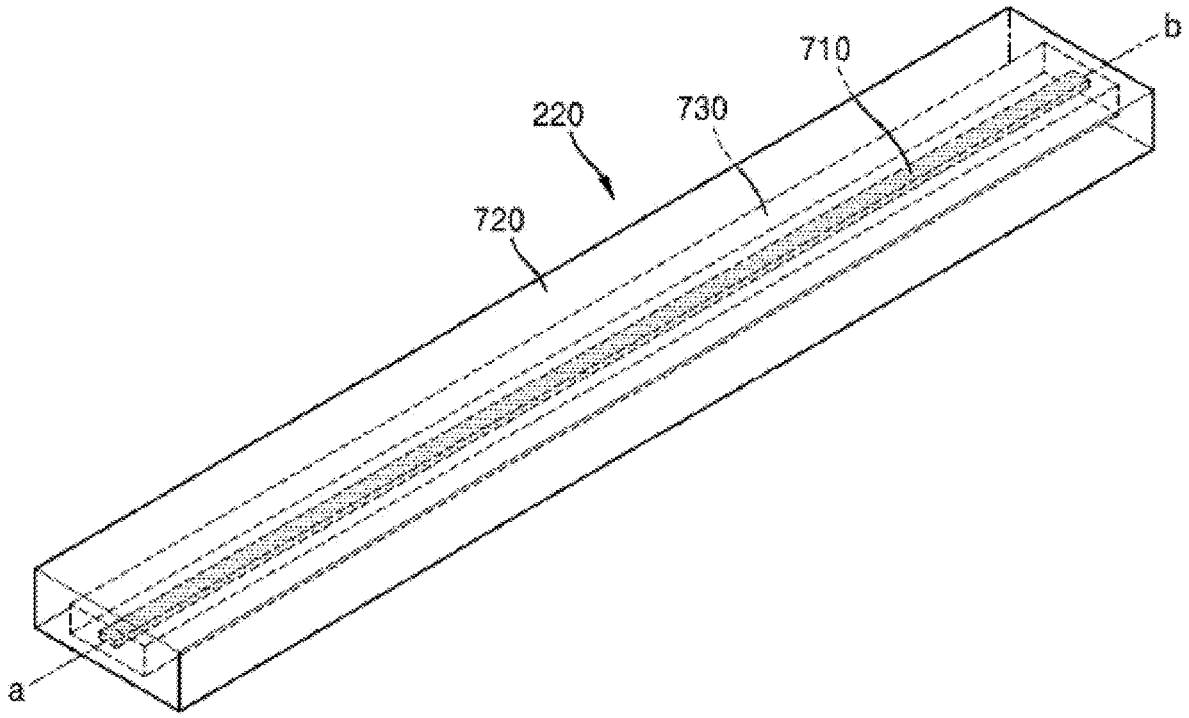
FIG. 7 is a perspective view of a transmission line (flat cable) which is a component of an example of a low-loss and flexible transmission line-integrated antenna for an mmWave band according to the present invention.
Figure 8:
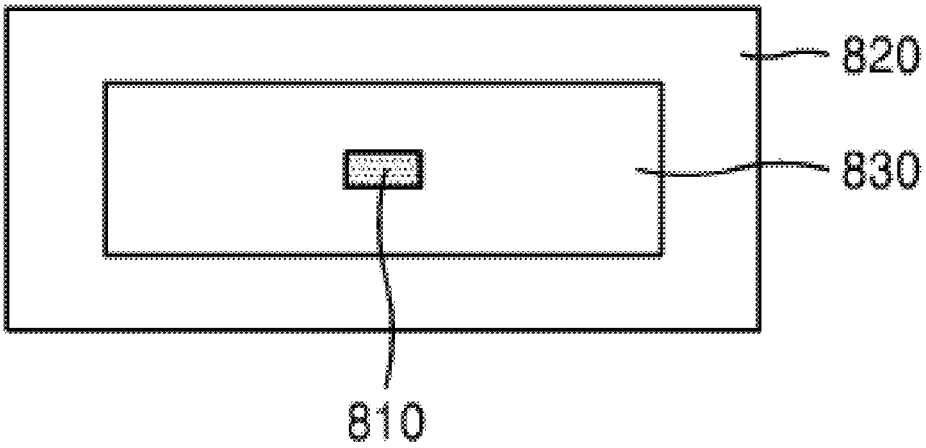
FIG. 8 is a front view of a transmission line which is a component of an example of a low-loss and flexible transmission line-integrated antenna for an mmWave band according to the present invention.

FIG. 7 is a perspective view of a transmission line having the form of a flat cable which is a component of an example of a low-loss and flexible transmission line-integrated antenna for an mmWave band according to the present invention. FIG. 8 is a front view of a transmission line (flat cable) which is a component of an example of a low-loss and flexible transmission line-integrated antenna for an mmWave band according to the present invention.

Referring to FIGS. 1 to 8, the transmission line 120, 220, or 320 includes a central conductor 710 or 810, an external conductor 720 or 820, and a dielectric 730 or 830.

One end of the central conductor 710 or 810 is connected to the electricity feeding portion 440, 540, or 640 of the antenna 110, 210, or 310 and transmits, as a signal line, the transmitted or received electrical signal.

The external conductor 720 or 820 has the same axis as that of the central conductor 710 or 810 and shields the central conductor 710 or 810 in an axial direction a-b of the central conductor.

The dielectric 730 or 830 is formed between the central conductor and the external conductor in the axial direction.

The dielectric substrate 420, 520, or 620 used in the antenna 110, 210, or 310 and the dielectric 730 or 830 used in the transmission line 120, 220, or 320 may be a material having a nano-structure formed by electrospinning a resin of a variety of phases (solid, liquid, and gas) at a high voltage.

Figure 9:
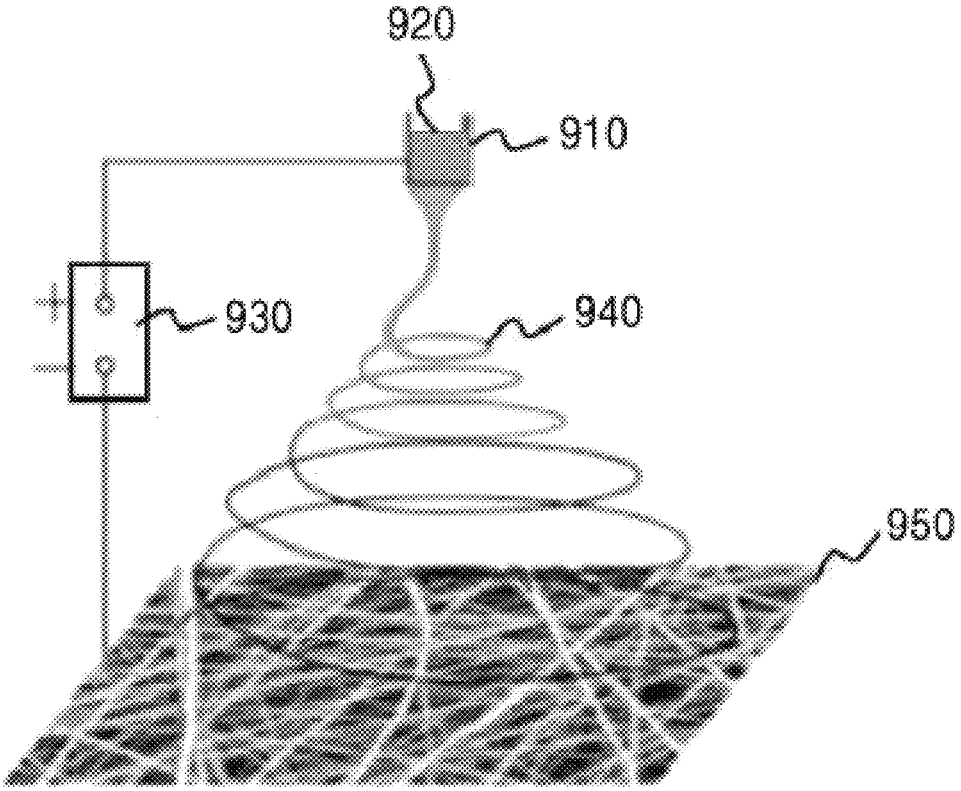
FIG. 9 illustrates an example of an apparatus which manufactures nanoflon through electrospinning.

A nano-structure material used as a material of the dielectrics which form the antenna and transmission line in the low-loss and flexible transmission line-integrated antenna for an mmWave band according to the present invention is a material formed by selecting an adequate resin among a variety of phases (solid, liquid, and gas) and electrospinning the resin at a certain high voltage and will be referred to as nanoflon in the specification. FIG. 9 illustrates an example of an apparatus which manufactures nanoflon through electrospinning. When a polymer solution 920 including polymers is injected into an injector 910 and a high voltage 930 is applied and the polymer solution flows at a certain speed into between the injector 910 and a substrate on which spinning is performed, as electricity is applied to a liquid suspended from an end of a capillary due to surface tension, a nano-sized thread 940 is formed, and as time passes, non-woven nanofibers 950 having a nanostructure are accumulated. A material formed of the accumulated nanofibers is nanoflon. As the polymer material used for electrospinning, for example, there are polyurethane (PU), polyvinylidine diflouride (PVDF), nylon (polyamide), polyacrylonitrile (PAN), and the like. Nanoflon has a low dielectric constant and a large amount of air and may be used as a dielectric of a transmission line and a dielectric substrate of an antenna. A relative dielectric constant ($\varepsilon r$) of nanoflon used in the present invention is about 1.56, and Tan $\delta$ that is a dielectric loss tangent value is about 0.0008. In comparison to those of polyimide having a relative dielectric constant of 4.3 and a dielectric loss tangent value of 0.004, the relative dielectric constant and dielectric loss tangent value of the nanoflon are significantly low. However, the transmission line-integrated antenna according to the present invention uses a low-loss and flexible material so as to be flexible and to provide flexibility in installation even in a small space of a smart phone.

Meanwhile, the dielectric used in FIGS. 1 to 8 may be a nanosheet dielectric having a nanostructure formed by electrospinning a resin in a variety of phases at a high voltage.

The conductor and the nanosheet dielectric included in the low-loss and flexible transmission line-integrated antenna for an mmWave band shown in FIGS. 1 to 8 include not only a single lamination structure but also a multilayer structure in which a plurality of layers are repeated so as to transmit and receive a multiple signal at the same time. Also, for a bonding structure which increases reliability between the conductor and the nanosheet dielectric, the conductor and the nanosheet dielectric may be connected using a bonding sheet of a structure having a low relative dielectric constant of a thin film layer and a low dielectric loss.

Also, the low-loss and flexible transmission line-integrated antenna according to the present invention includes a microstrip patch signal radiator, a variety of shapes of patch type antenna radiator structure, or a diagonal line type patch antenna structure. An antenna radiator patch may be located on an uppermost end surface, a nanosheet dielectric having a certain thickness may be formed on a bottom surface of the antenna radiator patch, and a ground plate formed of a metal may be formed on a lowermost end surface. Particularly, for efficient coupling between each of the conductors and the nanosheet dielectric, a bonding force may be reinforced using a low-loss dielectric bonding sheet and a conductor may be deposited on a nanosheet dielectric to be utilized.

Also, a transmission line integrated with an antenna in a low-loss and flexible transmission line-integrated antenna may use same nanosheet dielectrics as dielectrics. Referring to FIG. 1C, the transmission line 120 includes a nanosheet dielectric 126 having a certain thickness, conductors 128 and 129 formed on a top surface and a bottom surface of the nanosheet dielectric 126, and a stripline signal line 124 formed as a signal line in a center of the nanosheet dielectric 126 and the conductors 128 and 129. A plurality of via holes 122 may be formed between a conductor surface 128 formed above the nanosheet dielectric 126 and a conductor surface 129 formed below the nanosheet dielectric 126. That is, the low-loss and flexible transmission line-integrated antenna according to the present invention may include a stripline structure in which the plurality of via holes are formed an edge in a longitudinal direction of the transmission line 120 in a direction parallel to the signal line 124. The stripline signal line 124 is directly connected to a radiator patch conductor 112 of the antenna.

The plurality of via holes 122 are SIW structures to prevent a leakage of the signal line and transmission and reception of noise and provide an excellent noise cut property with respect to a broadband such as an mmWave band.

Figure 10:
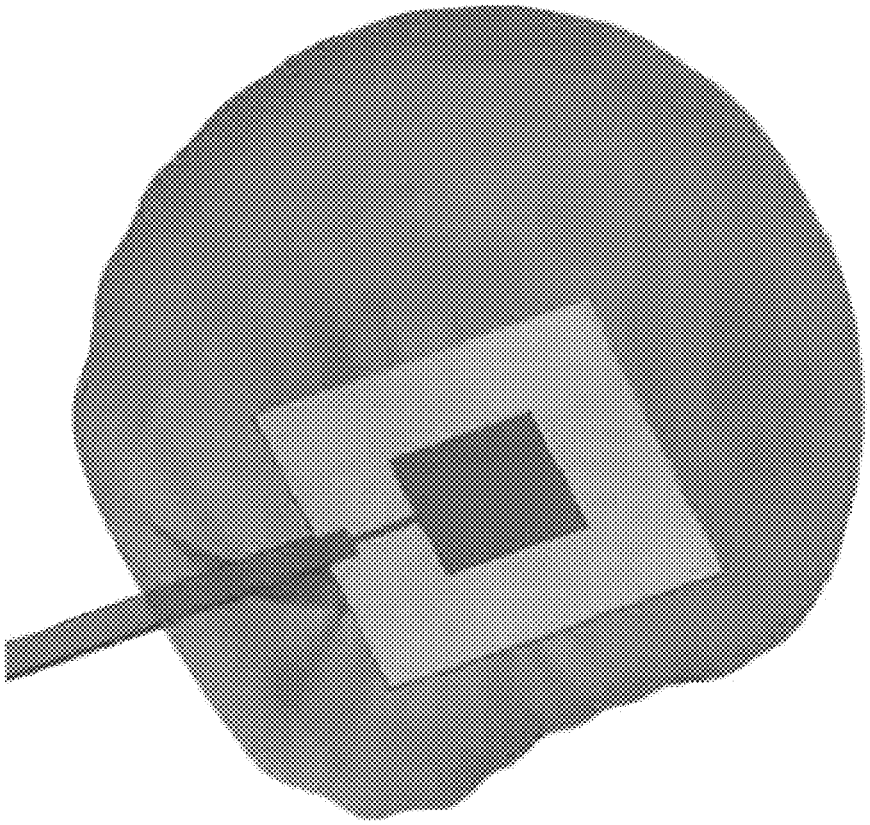
FIG. 10 illustrates a beam pattern (radiation pattern) of a transmission line-integrated patch antenna as an example of the low-loss and flexible transmission line-integrated antenna for mmWave band according to the present invention.

FIG. 10 illustrates a beam pattern (radiation pattern) of a transmission line-integrated patch antenna as an example of the low-loss and flexible transmission line-integrated antenna for mmWave band according to the present invention. The beam pattern is an electric field strength of a radiated electromagnetic wave and indicates directivity.

Figure 11:
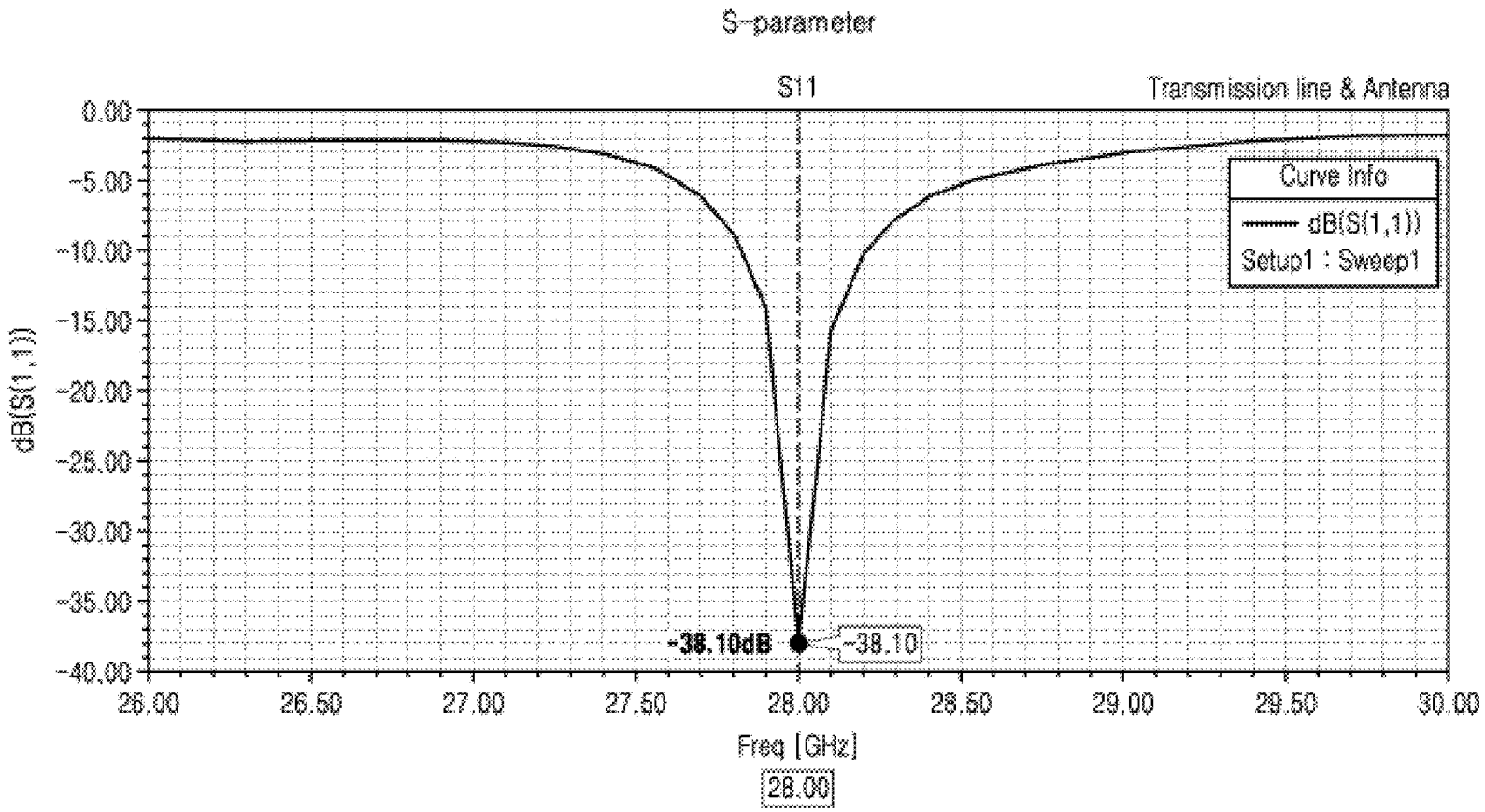
FIG. 11 illustrates an input reflection parameter S11 according to a frequency of the transmission line-integrated patch antenna as the example of the low-loss and flexible transmission line-integrated antenna for mmWave band according to the present invention.

FIG. 11 illustrates an input reflection parameter S11 according to a frequency of the transmission line-integrated patch antenna as the example of the low-loss and flexible transmission line-integrated antenna for mmWave band according to the present invention. Referring to FIG. 11, it may be seen that, in the transmission line-integrated patch antenna according to one embodiment of the present invention, an S11 value decreases at a frequency of 28 GHz that is a 5G communication frequency and signal power input into the antenna is reflected, does not return, is maximally radiated outside through the antenna, has high radiation efficiency, and is well matched.

Figure 12:
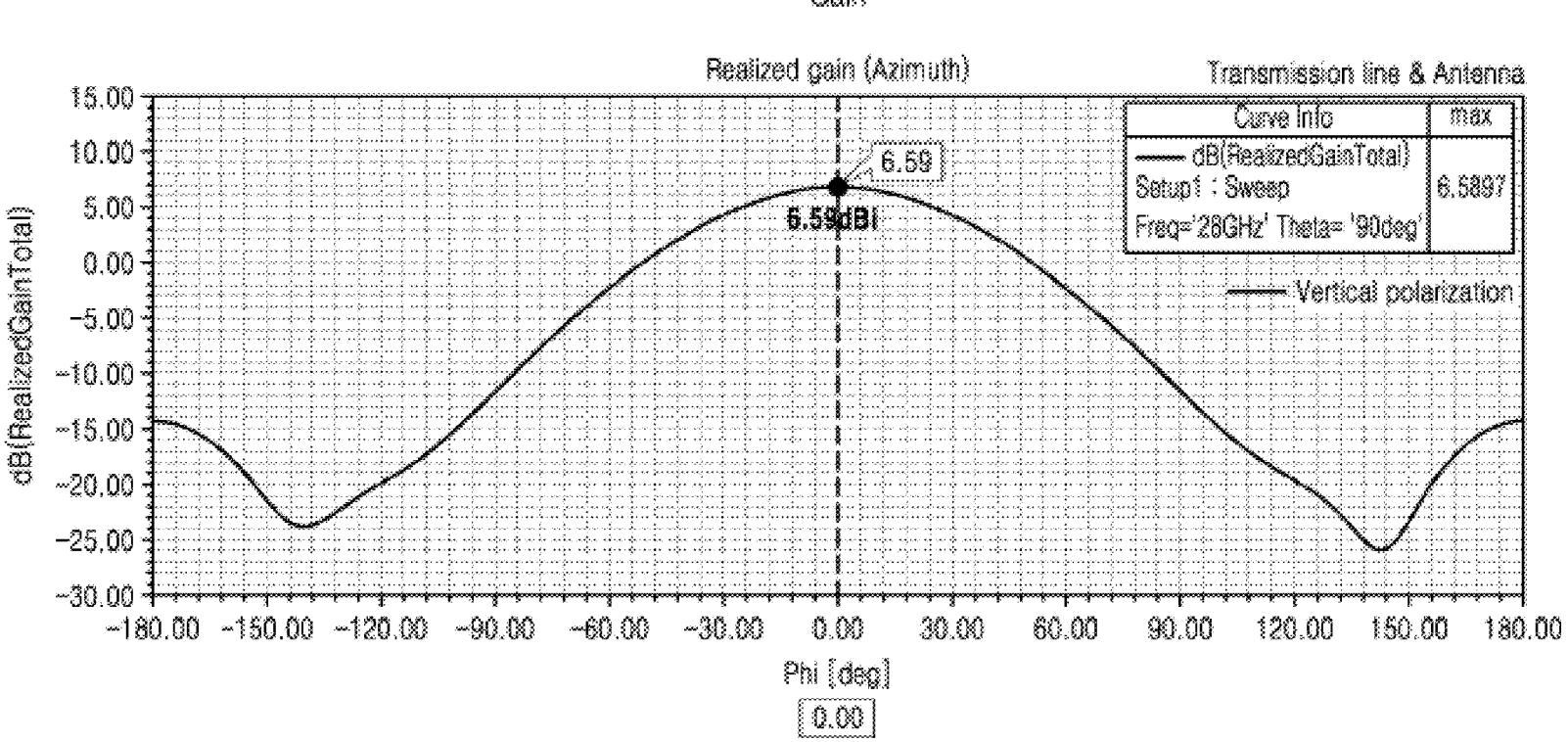
FIG. 12 illustrates a gain property of the transmission line-integrated patch antenna as the example of the low-loss and flexible transmission line-integrated antenna for mmWave band according to the present invention.

FIG. 12 illustrates a gain property of the transmission line-integrated patch antenna as the example of the low-loss and flexible transmission line-integrated antenna for mmWave band according to the present invention. Referring to FIG. 12, it may be seen that the antenna has a very high antenna gain property of about 6.6 dBi at 0 radian as a gain property of vertical polarization.

Meanwhile, the low-loss and flexible transmission line-integrated antenna for an mmWave band includes not only a patch antenna or a microstrip patch antenna but also an antenna and a transmission line using dielectrics. For example, the antenna according to the present invention may be applied to a dipole antenna or a monopole antenna. Also, the antenna is a built-in antenna built in a mobile communication terminal and may be applied to a planar inverted F antenna (PIFA).

Figure 13:
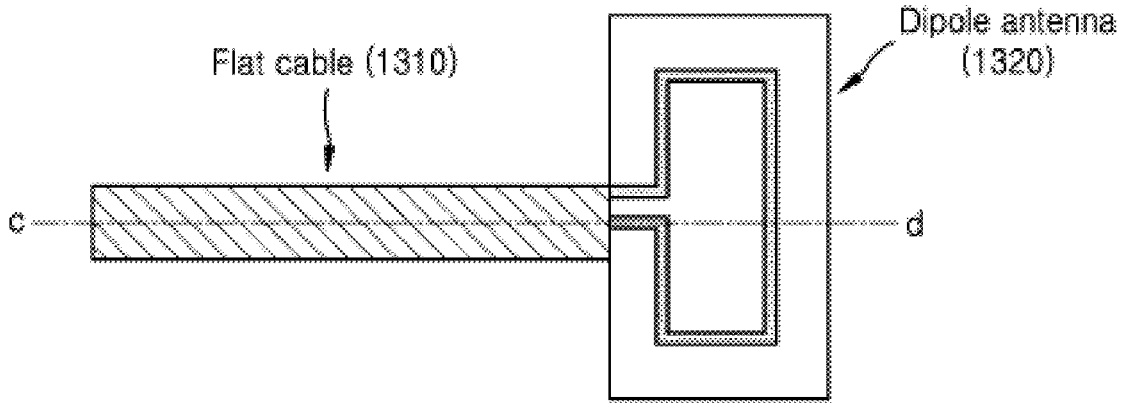
FIG. 13 is a plan view of a transmission line-integrated dipole antenna as an example of a low-loss and flexible transmission line-integrated antenna for an mmWave band according to the present invention.
Figure 14:
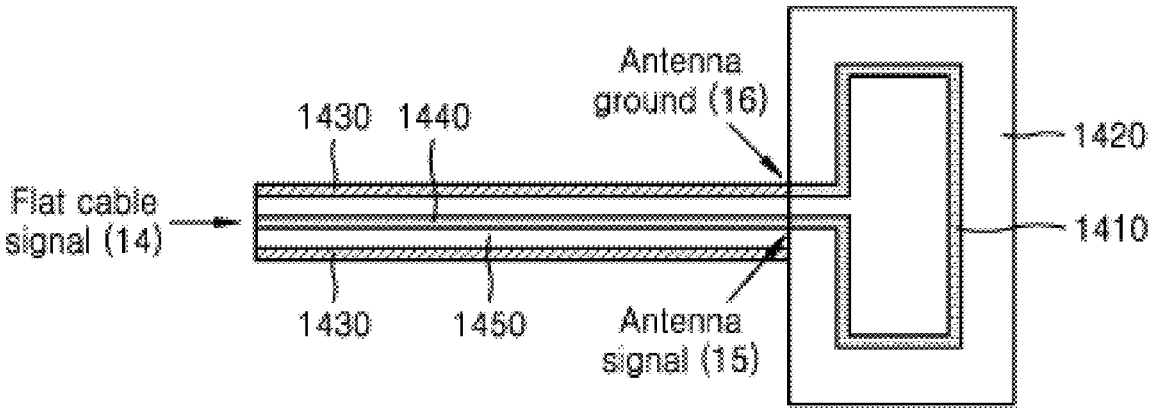
FIG. 14 is an axial cross-sectional view of a transmission line-integrated dipole antenna as an example of a low-loss and flexible transmission line-integrated antenna for an mmWave band according to the present invention.

FIG. 13 is a plan view of a transmission line-integrated dipole antenna as another example of a low-loss and flexible transmission line-integrated antenna for an mmWave band according to the present invention. FIG. 14 is an axial (c-d of FIG. 13) cross-sectional view of a transmission line-integrated dipole antenna as another example of a low-loss and flexible transmission line-integrated antenna for an mmWave band according to the present invention.

Referring to FIGS. 13 and 14, the transmission line-integrated dipole antenna includes a flat cable 1310 that is a transmission line and a dipole antenna 1320 integrated with the flat cable 1310. Also, the dipole antenna 1320 includes a dipole signal conversion portion 1410 and a dielectric 1420, and the transmission line 1310 includes a central conductor 1440 which transmits a signal, an external conductor 1450, and a dielectric 1450 which is formed of a material having a low dielectric constant and a low loss between the central conductor and the external conductor.

The transmission line-integrated dipole antenna according to another embodiment of the present invention includes one end 15 connected to a signal line of the flat cable 1310 and another end 16 connected to a ground line of the antenna.

Figure 15:
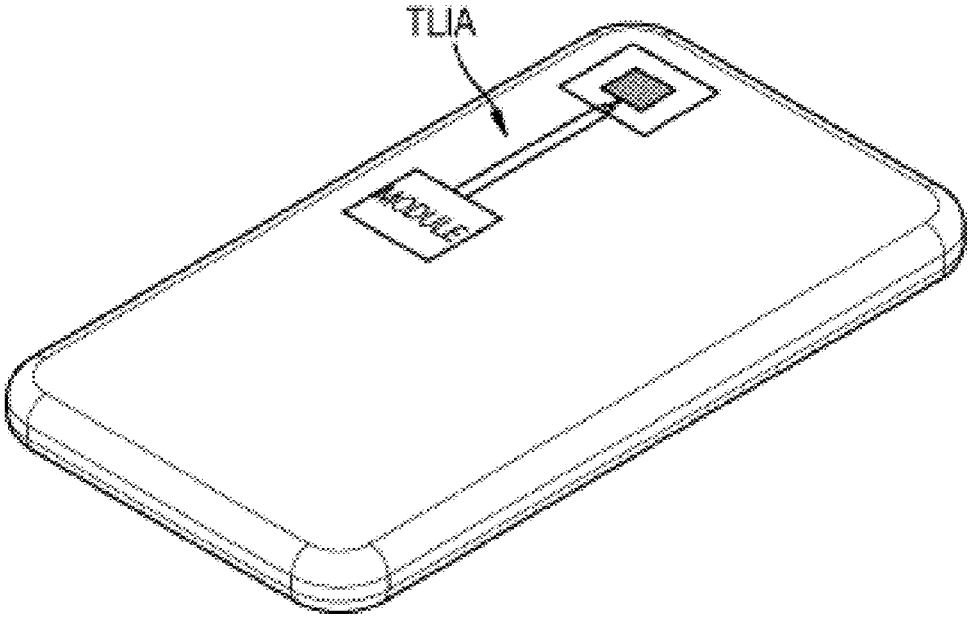
FIG. 15 illustrates an example of a mobile communication device on which the low-loss and flexible transmission line-integrated antenna for an mmWave band according to the present invention is mounted.

Meanwhile, FIG. 15 illustrates an example of a mobile communication device on which the low-loss and flexible transmission line-integrated antenna for an mmWave band according to the present invention is mounted. Referring to FIG. 15, the mobile communication terminal according to the present invention includes a low-loss and flexible transmission line-integrated antenna TLIA according to the present invention which is connected to a circuit module of the mobile communication terminal, transmits and receives an electrical signal, and radiates electromagnetic waves through an antenna.

According to the embodiments of the present invention, a low-loss and flexible transmission line-integrated antenna for an mmWave band may be used as an antenna for a high frequency band of several ten gigas used in a smart phone of a next-generation 5G mobile communication system.

Particularly, the low-loss and flexible transmission line-integrated antenna according to the embodiments of the present invention uses a dielectric material having a low relative dielectric constant and a low loss tangent value for dielectrics used in a transmission line and an antenna so as to transmit or radiate a superhigh frequency signal at a less loss.

Also, in the low-loss and flexible transmission line-integrated antenna according to the embodiments of the present invention, a loss which may occur due to a connection portion between the transmission line and the antenna may be eliminated by integrating the transmission line with the antenna so as to reduce a loss of a signal in a superhigh frequency band.

Also, a mobile built-in antenna may be implemented using a flexible material having flexibility so as to locate the antenna at a position of minimizing an influence of surroundings in a mobile device such as a smart phone and the like.

Although the present invention has been described with reference to the embodiments shown in the drawings, it should be understood that the embodiments are merely examples and a variety of modifications and equivalents thereof may be made by one of ordinary skill in the art. Therefore, the technical scope of the present invention should be defined by the technical concept of the attached claims.

What is claimed is:

1. A low-loss and flexible transmission line-integrated antenna for an mmWave band, comprising:

an antenna; and a transmission line integrated with the antenna, wherein the antenna comprises:

a dielectric substrate formed of a dielectric having a certain thickness on a ground plate;

a signal conversion portion which is formed on the dielectric substrate and converts an electrical signal of a mobile communication terminal into an electromagnetic signal and radiates the electromagnetic signal into the air or receives an electromagnetic signal in the air and converts the electromagnetic signal into an electrical signal of the mobile communication terminal; and an electricity feeding portion formed on the dielectric substrate and connected to the signal conversion portion, wherein the transmission line comprises:

a central conductor which has one end connected to the electricity feeding portion of the antenna and transmits the transmitted or received electrical signal;

an external conductor which has the same axis as that of the central conductor and surrounds the central conductor in an axial direction of the central conductor; and a dielectric formed between the central conductor and the external conductor in the axial direction, and wherein the dielectric is a sheet material having a nanostructure formed by electrospinning a resin at a high voltage.

2. The low-loss and flexible transmission line-integrated antenna of claim 1, wherein the antenna and the transmission line reinforce a bonding force of the conductor and the dielectric sheet using a low-loss bonding sheet or are formed by depositing a conductor on a nanosheet.

3. The low-loss and flexible transmission line-integrated antenna of claim 1, wherein the transmission line comprises:

a nanosheet dielectric having a certain thickness;

conductor surfaces formed on a top surface and a bottom surface of the nanosheet dielectric; and a stripline transmission line formed as a signal line in the nanosheet dielectric and a middle of the conductor surfaces, and wherein a plurality of via holes are formed between the conductor surface formed above the nanosheet dielectric and the conductor surface formed below the nanosheet dielectric.

4. The low-loss and flexible transmission line-integrated antenna of claim 1, wherein the antenna is a patch antenna, a microstrip patch antenna, or a diagonal line type patch antenna structure and the signal conversion portion is a patch, wherein the patch antenna or the microstrip antenna is formed of a metal and further comprises a ground plate located on the bottom surface, and wherein the dielectric substrate is formed of a dielectric having a certain thickness on the ground plate and has a transmission line-extended structure.

5. The low-loss and flexible transmission line-integrated antenna of claim 1, wherein the antenna is a dipole antenna or a monopole antenna.

6. The low-loss and flexible transmission line-integrated antenna of claim 1, wherein the antenna is a planar inverted F antenna (PIFA) as a built-in antenna built in a mobile communication terminal.

7. The low-loss and flexible transmission line-integrated antenna of claim 1, wherein the antenna is a slot antenna implemented through a variety of slots.

8. A mobile communication terminal comprising the low-loss and flexible transmission line-integrated antenna for an mmWave band according to claim 1.

9. The mobile communication terminal of claim 8, wherein the antenna and the transmission line reinforce a bonding force of the conductor and the dielectric sheet using a low-loss bonding sheet or are formed by depositing a conductor on a nanosheet.

10. The mobile communication terminal of claim 8, wherein the transmission line comprises:

a nanosheet dielectric having a certain thickness;

conductor surfaces formed on a top surface and a bottom surface of the nanosheet dielectric; and a stripline transmission line formed as a signal line in the nanosheet dielectric and a middle of the conductor surfaces, and wherein a plurality of via holes are formed between the conductor surface formed above the nanosheet dielectric and the conductor surface formed below the nanosheet dielectric.

11. The mobile communication terminal of claim 8, wherein the antenna is a patch antenna, a microstrip patch antenna, or a diagonal line type patch antenna structure and the signal conversion portion is a patch, wherein the patch antenna or the microstrip antenna is formed of a metal and further comprises a ground plate located on the bottom surface, and wherein the dielectric substrate is formed of a dielectric having a certain thickness on the ground plate and has a transmission line-extended structure.

12. The mobile communication terminal of claim 8, wherein the antenna is a dipole antenna or a monopole antenna.

13. The mobile communication terminal of claim 8, wherein the antenna is a planar inverted F antenna (PIFA) as a built-in antenna built in a mobile communication terminal.

14. The mobile communication terminal of claim 8, wherein the antenna is a slot antenna implemented through a variety of slots.

* * * * *